United States Patent [19]

Ball

[11] Patent Number: 4,558,206

[45] Date of Patent: Dec. 10, 1985

[54] ELECTRIC HEATING APPARATUS FOR PROVIDING FREEZE PROTECTION FOR FLUID-CONTROL DEVICES AT WELL SITES

[76] Inventor: Randell D. Ball, 1141 Elk, Yukon, Okla. 73099

[21] Appl. No.: 533,069

[22] Filed: Sep. 19, 1983

[51] Int. Cl.[4] ..... H05B 1/02; H05B 3/34; E03B 7/10; F16K 49/00

[52] U.S. Cl. ..... 219/301; 137/341; 138/33; 219/201; 219/279; 219/526; 219/528; 219/535; 219/536

[58] Field of Search ..... 219/200, 201, 301, 535, 219/528, 529, 549, 279, 526, 536; 138/33; 137/341

[56] References Cited

U.S. PATENT DOCUMENTS

| | | | |
|---|---|---|---|
| 2,404,736 | 7/1946 | Marick | 219/528 |
| 2,518,863 | 8/1950 | Camden et al. | 219/201 |
| 3,120,600 | 2/1964 | True | 219/301 |
| 3,275,803 | 9/1966 | True | 219/301 X |
| 3,374,338 | 3/1968 | Morey | 219/535 X |
| 3,657,517 | 4/1972 | Hoyt | 219/535 |
| 3,731,534 | 5/1973 | Painley et al. | 219/201 X |
| 4,061,898 | 12/1977 | Murray et al. | 219/527 X |
| 4,191,524 | 3/1980 | Thorn | 219/296 X |

FOREIGN PATENT DOCUMENTS

| | | | |
|---|---|---|---|
| 42862 | 4/1979 | Japan | 219/301 |
| 159749 | 12/1979 | Japan | 219/301 |

OTHER PUBLICATIONS

"Solar Energy Used for Production"; by Dave Horan; Oil and Gas Journal; Mar. 6, 1978, pp. 80–82, 88, 90.

*Primary Examiner*—A. Bartis

*Attorney, Agent, or Firm*—E. Harrison Gilbert, III

[57] ABSTRACT

An electric heating apparatus for providing freeze protection for a fluid-control device, such as a gas regulator, at a well site includes a flexible electric heating pad adapted to be wrapped around the control device to be freeze-protected and a two part thermally insulated housing adapted to be placed about the heating pad and control device when the apparatus is installed. The heating pad is adapted to be energized from a rechargeable battery under the control of a thermostat within the housing which disconnects heating pad from the battery when the temperature in the housing rises above a temperature of about 40° F. A solar panel provides direct current for recharging the battery. A second thermostat disconnects the solar panel from the battery when the ambient temperature rises above about 50° F. to terminate charging of the battery.

7 Claims, 8 Drawing Figures

ELECTRIC HEATING APPARATUS FOR PROVIDING FREEZE PROTECTION FOR FLUID-CONTROL DEVICES AT WELL SITES

BACKGROUND OF THE INVENTION

This invention relates generally to apparatus for heating a fluid-control device disposed in a conduit at a well site and more particularly, but not by way of limitation, to apparatus for insulating and heating a gas regulator mechanism known as a "Little Joe."

Various valves and regulator devices are found at oil and gas well sites. Because the fluids flowing through these devices contain liquids which can freeze and render the devices inoperable, it is important that some means for keeping the devices from freezing or for thawing them when they become frozen be provided. For example, it is known in the art that gas regulators known as "Little Joes" can freeze whereby the gas regulation function is not provided. To thaw these frozen gas regulators, the prescribed maintenance procedure is to disassemble the regulator and remove the ice plug which is formed; however, in actual practice a short-cut is frequently taken whereby ignited gasoline-soaked rags or flaming torches are applied directly to the frozen device to thaw it. These techniques utilizing flaming rags or torches are extremely dangerous techniques because there is no accurate control of the heat applied to the device. This can create an explosion due to the increased pressure differentials created within the device by the inadequately controlled high heat. This opportunity for explosion is enhanced in a "Little Joe" because of the possibility of a worn gasket which seals an aperture opening to the atmosphere for atmospheric pressure control and because of a faulty casting which can occur in some of these devices due to the effects of freezing.

Therefore, there is the need for an insulated apparatus to control the heating applied to a device at a well site to prevent it from freezing or, if frozen, to safely thaw it. To insure adequate control, the heating mechanism within the apparatus should be electrically energized from a source including a primary power supply and a reserve power supply to insure continued operability in the remote locations at which well sites are often found. These power sources should be efficient to reduce the cost of their operation. The heating mechanism should also be maintained in an insulated housing to protect the device from the environment and to assist in the insulation feature of such a needed apparatus.

SUMMARY OF THE INVENTION

The present invention overcomes the above-noted and other shortcomings of the prior art by providing a novel and improved apparatus for heating a fluid-control device disposed at a well site. The apparatus includes an electrical heating element energized by either a primary or reserve power source, the reserve power source including an energy efficient device such as a solar panel. The inventive apparatus also provides an insulated housing to protect the heating element and to assist in insulating the fluid-control device.

Broadly, the apparatus of the present invention includes an electrical heating pad disposable on a fluid-control device and means for providing electricity to the heating pad. The apparatus further comprises an insulated housing means for enclosing the fluid-control device and the heating pad. In a preferred embodiment, the means for providing electricity includes a battery, solar means for generating electricity in response to sunlight, and connector means for interconnecting the battery, the solar means and the heating pad.

Therefore, from the foregoing, it is a general object of the present invention to provide a novel and improved apparatus for heating a fluid-control device disposed at a well site. Other and further objects, features and advantages of the present invention will be readily apparent to those skiled in the art when the following description of the preferred embodiment is read in conjunction with the accompanying drawings.

DETAILED DESCRIPTION OF THE PREFERRED EMBODIMENT

Figure 7:
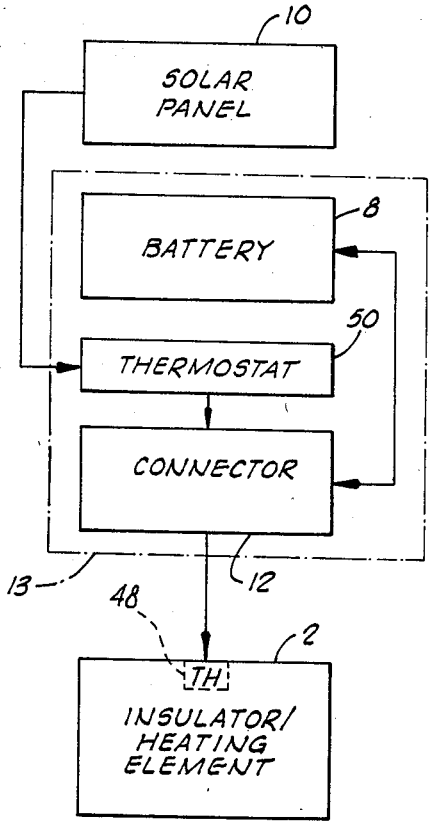
FIG. 7 is a functional block diagram of the apparatus of the present invention.
Figure 8:
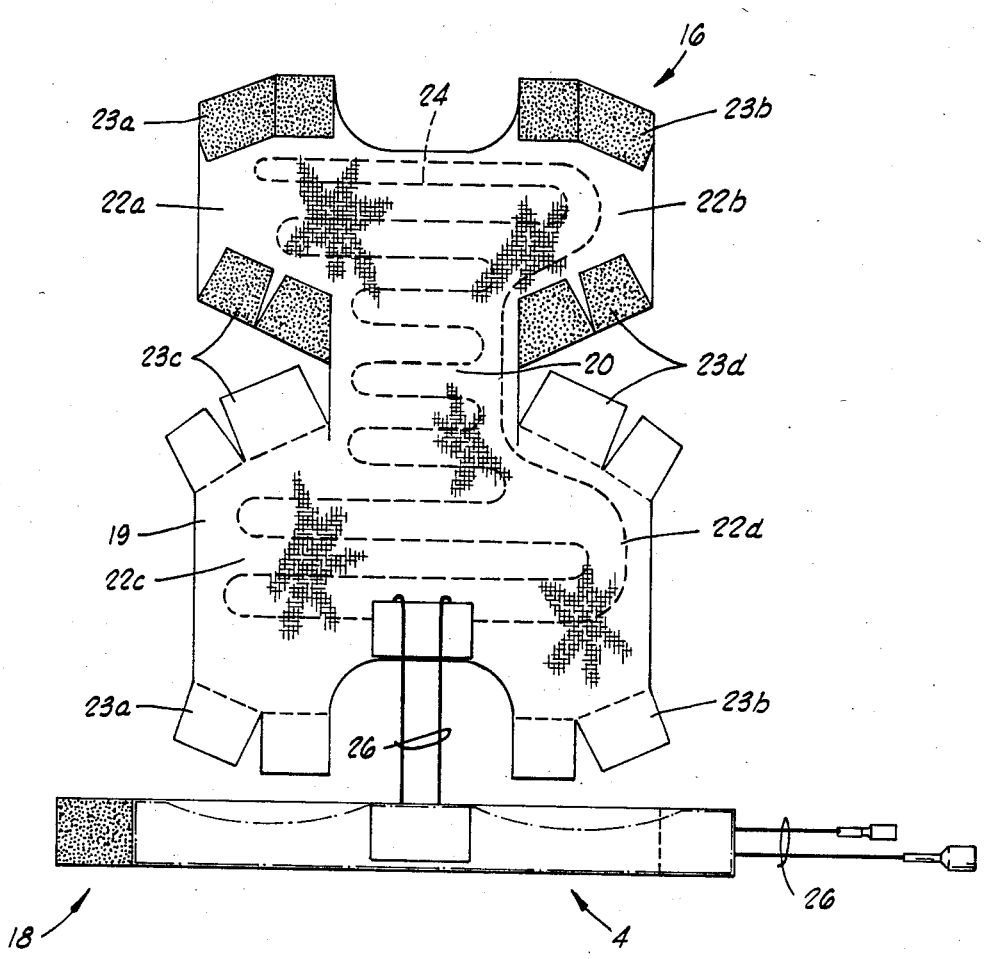
FIG. 8 is a plan view of the heating member of the preferred embodiment of the present invention.

With initial reference to FIG. 7, the broad elements of the apparatus constructed in accordance with the preferred embodiment of the present invention will be described. This apparatus includes an insulator/heating element 2 comprising a heating member 4 (see FIGS. 3 and 8) and an insulated housing 6 (see FIGS. 1–6). The apparatus also includes means for providing electricity to the heating member 4, which means includes in the preferred embodiment a battery 8, a solar panel 10, and connector means 12 for connecting the battery 8 and the solar panel 10 to provide electricity to the heating element 4 and a recharging current to the battery 8. In the preferred embodiment the battery 8 and connector means 12 are retained within a common container, such as a metal box, as illustrated by the dashed line enclosure 13 shown in FIG. 7. This apparatus is used in the preferred embodiment with a gas regulator 14 indicated in dot-dash lines in FIGS. 3, 5 and 6. The gas regulator 14 is known to the art as a "Little Joe" and is connected into a gas pipeline via a pipe 15 at a gas well as also known to the art. It is contemplated, however, that the present invention can be used with other types of devices.

The heating member 4 applies heat to the gas regulator 14. In the preferred embodiment, the heating member 4 includes an electrical heating pad 16 and an electrical heating collar 18.

The electrical heating pad 16 of the preferred embodiment includes a flexible, silicone rubber body 19 having a central web 20 and four legs **22*a*, 22*b*, 22*c* and 22*d* extending outwardly from the web 20. The legs 22*a*, 22*b*, 22*c* and 22*d*** extend in the preferred embodiment to define the flexible body in a substantially X-shaped configuration.

The electrical heating pad 16 also includes securing means for enabling each of the legs *22a, 22b, 22c, 22d* to be attached to a respective one of the other legs so that the flexible body can be retained on the regulator 14. As illustrated in the drawings, the securing means of the preferred embodiment comprises paired sets of Velcro-type fasteners *23a, 23b, 23c, 23d*. Each set is shown as having two surfaces which connect with matching surfaces of the respective paired set. When secured around the regulator 14, the pad 16 of the preferred embodiment is disposed only about the portion of the regulator which is connected directly to the pipe 15 as shown in FIG. 3.

Disposed within the flexible body 19 is a heating element 24 such as a wire or the like as known to the art. For connecting the heating element 24 to the electricity providing means, the apparatus further includes conductor means 26.

Figure 3:
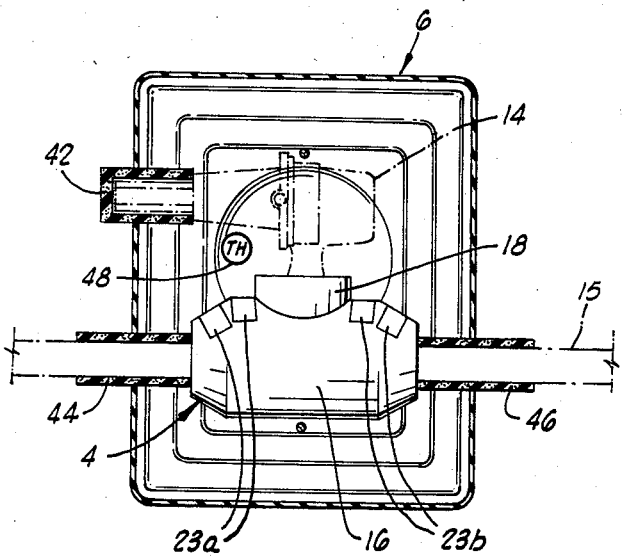
FIG. 3 is a sectional side elevational view taken along line 3—3 shown in FIG. 2.
Figure 4:
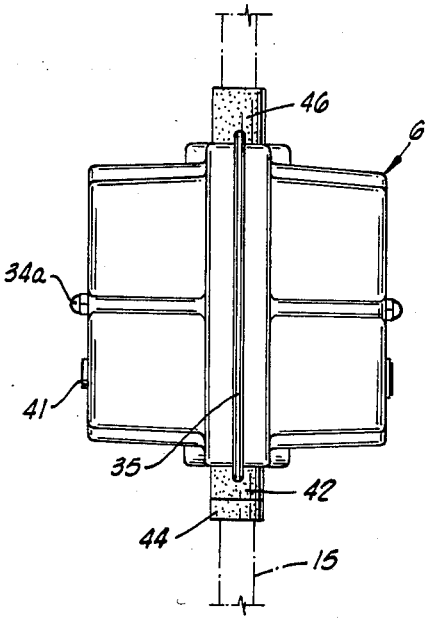
FIG. 4 is another end view of the housing of the preferred embodiment of the present invention.
Figure 6:
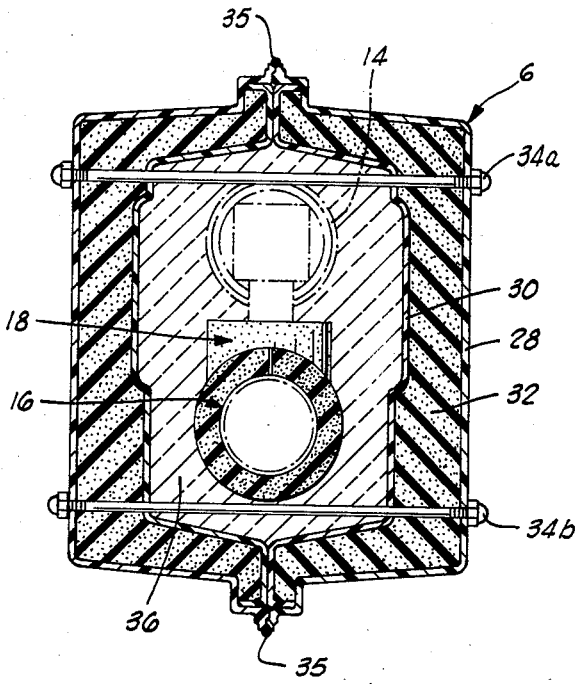
FIG. 6 is a sectional end elevational view taken along line 6—6 shown in FIG. 1.

The collar 18 is constructed similarly to the heating pad 16 except for the shape, which in the collar 18 is a substantially rectangular shape which becomes a ring-shape when the two ends of the collar 18 are connected (via similar Velcro-type fasteners) around the regulator 14 as illustrated in FIGS. 3 and 6. The collar 18 has a heating element passing therethrough. This element is connected to the one of the pad 16 by the conductor means 26.

As shown in FIG. 3, the electrical heating pad 16 and the electrical heating collar 18 are suitably secured to the regulator 14, and the regulator 14 and the heating pad and collar 16, 18 are retained within the housing 6. The housing 6 provides an insulated enclosure for these elements to protect them from freezing and the outdoor environment. The housing 6 comprises two halves, each of which is similarly constructed. Each half includes an outer shell 28 and an inner shell 30 (see FIGS. 5–6). The two shells 28, 30 are associated so that there is defined a void region in which insulation 32 is contained. The insulation 32 is of any suitable type known to the art. The two halves, each of which is defined by a respective set of the first and second shells 28, 30 and the insulation 32, provide first and second members which are connected to each other by suitable fastening means such as nuts and bolts *34a, 34b* as illustrated in FIG. 6. The resulting joint between the two halves is made fluid-resistant or fluid-tight by a perimetrically extending sealing bead 35, such as one made of a suitable caulk. As shown in FIG. 6, for example, this resulting joint comprises offset complementary rims which engage so that the two halves are properly positioned relative to each other and further so that a V-shaped edge groove is defined for receiving the exemplary bead 35 of caulk.

Each of the two halves includes a cavity defined by the respective set of shells 28, 30. When the two halves are connected by the nuts and bolts *34a, 34b*, these cavities adjoin to define a single central interior hollow region in which the regulator 14 is contained when the housing 6 is mounted thereon. Batt insulation 36 is disposed in this central interior region to further insulate and cushion the regulator 14.

Figure 1:
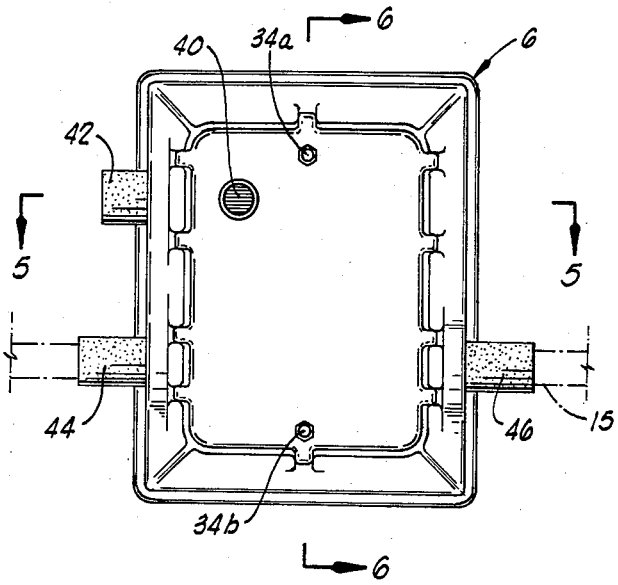
FIG. 1 is a side elevational view of the housing of the preferred embodiment of the present invention.

The housing 6 also includes a vent opening 38 defined therein for communicating atmospheric pressure to the interior cavity of the housing 6 for use in controlling the regulator 14 as known to the art. As shown in FIG. 1, the vent opening has a vent cover 40 mounted therein. The vent cover 40 has louvers which shed rain or other liquids to prevent or resist their entry into the housing 6 through the vent opening 38. The vent cover 40 can be rotated in the opening 38 so that the louvers can be properly positioned regardless of the disposition of the housing 6.

Figure 2:
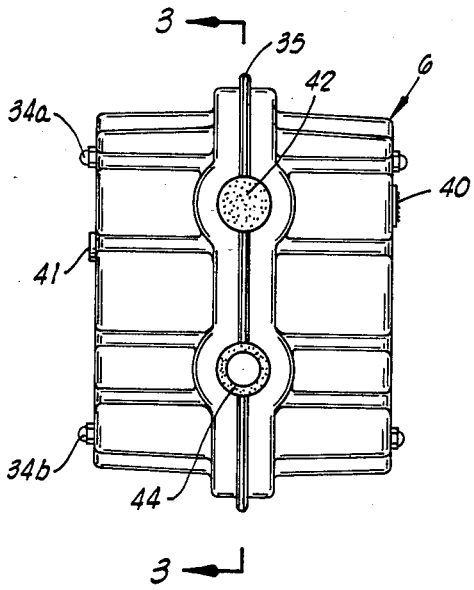
FIG. 2 is an end view of the housing of the preferred embodiment of the present invention.
Figure 5:
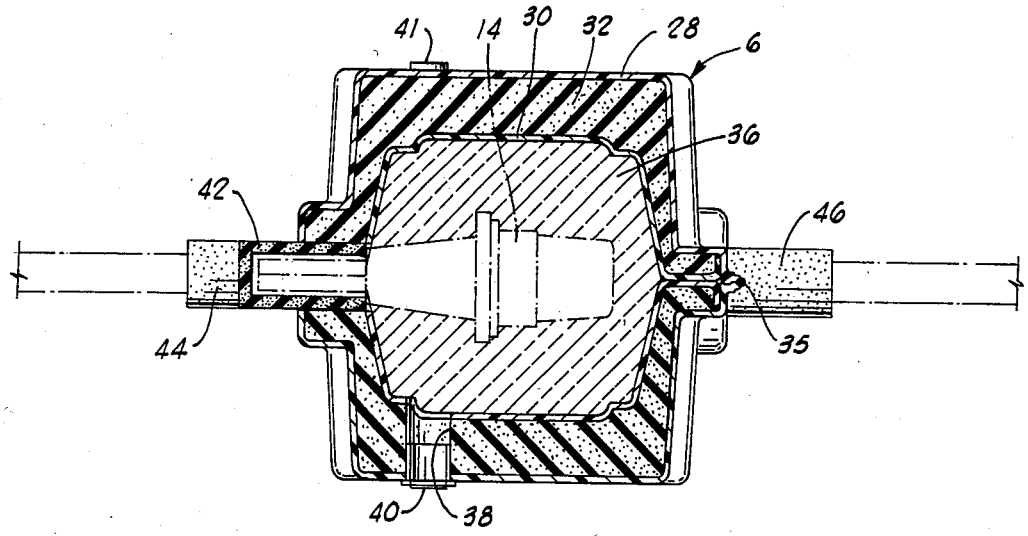
FIG. 5 is a sectional top view taken along line 5—5 shown in FIG. 1.

The housing 6 also includes an opening defined therein, which opening is shown in FIGS. 2 and 5 as having a grommet 41 associated therewith. The grommet 41 has a central resilient web which is slit to permit electrical conductors to be passed into the central interior region or cavity of the housing 6 for connection with the conductor means 26 and a thermostat subsequently identified. Being resilient, the web of the grommet 41 engages the electrical conductors passing therethrough to provide a colsure which resists leakage of water or other liquid.

It is contemplated that other embodiments of the housing 6 can be used. Examples of other embodiments of housings which are contemplated to be suitable for use in the present invention are disclosed in my copending United States patent application entitled Thermal Insulation Article (filed Sept. 9, 1983, and assigned Ser. No. 533,238).

As shown in FIGS. 1–5, the housing 6 has associated therewith a plurality of insulator sleeves 42, 44 and 46. The insulator sleeves 42, 44, 46 are cylindrically shaped and inserted through openings defined in the housing 6 through which pipes to the regulator 14 and a portion of the regulator 14 extend as illustrated in FIG. 3, for example.

The means for providing electricity to the heating member includes, as aforementioned, the battery 8, the solar panel 10 and the connector means 12. The battery 8 provides a source of direct current electricity which in the preferred embodiment is at a 12-volt potential having a current capacity capable of heating the heating pad and collar 16, 18 to 15 watts.

The solar panel 10 generates electricity from sunlight received by photoelectric cells of the solar panel 10. The solar panel 10 is of a suitable type as known to the art.

The connector means 12 provides means for electrically interconnecting the battery 8 and the solar panel 10 with the conductor 26 so that direct current electricity is provided to the heating elements of the pad 16 and collar 18. The connector means 12 also provides means for electrically interconnecting the solar panel 10 with the battery 8 to provide a recharging current to the battery 8. These interconnection means are of types known to the art.

The apparatus of the present invention further comprises first thermostatic control means for electrically disconnecting the heating member 4 from the electricity providing means when the temperature sensed by the first thermostatic control means exceeds a first reference level. In the preferred embodiment the thermostatic control means is any suitable device which controls the circuitry of the connector means 12 to disconnect electricity from the heating member 4 when a temperature above 40° F. is detected by the thermostatic device. This device is represented in FIG. 3 by the element 48 located adjacent one of the shells 30 between a heated part and an unheated part of the regulator 14.

The apparatus of the preferred embodiment also includes a second thermostatic control means for electrically disconnecting the solar panel 10 from its charging interconnection with the battery 8 when a temperature sensed by the second thermostatic control means exceeds a second reference level. In the preferred embodiment, the second thermostatic control means is also a suitable device as known to the art. The second thermostatic control means of the preferred embodiment detects a temperature above 50° F. and thereby controls the interconnections so that charging of the battery 8 is discontinued at such temperature. In the illustrated embodiment the second thermostatic control includes an element 50 mounted within the container 13 in which the battery 8 is also contained in the preferred embodiment. By so placing the thermostatic element 50, there is provided a safety mechanism by which charging of the battery 8 will cease if the temperature within the container 13 exceeds the reference level of 50° F. in the preferred embodiment.

In operation, the heating member 4 is wrapped around and secured to the regulator 14 as illustrated in FIG. 3. The housing 6 is mounted about the regulator 14 as shown in FIGS. 1–6. The battery 8 and the solar panel 10 are interconnected through the connector means 12 for providing electricity to the heating member 4. Operation thereafter automatically proceeds unless temperatures above the aforementioned reference levels are detected whereupon heating of the regulator 14 ceases or charging of the battery 8 ceases. Even when no heating of the regulator 14 occurs, it is being thermally insulated by the surrounding housing 6 and insulation 36.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for heating a fluid-control device disposed at a well, comprising:

a heating pad for applying heat to a first portion of a fluid-control device disposed at a well, said pad including:

a flexible member having a central web and four legs extending outward from said web;

means for connecting a first one of said legs to a second one of said legs about the fluid-control device;

means for connecting a third one of said legs to a fourth one of said legs about the fluid-control device;

heating element means, disposed in said flexible member, for generating heat in response to electricity; and conductor means for conducting electricity to said heating element means;

an insulated housing having an interior cavity defined therein, said housing including a first member, a second member and means for connecting said first member to said second member about said heating pad when said apparatus is installed on the fluid-control device;

a rechargeable battery;

a solar panel for generating electricity to recharge said battery;

first connector means for electrically connecting said battery to said conductor means, said first connector means including first thermostatic control means, disposed in said housing, for providing an energizing electrical path between said battery and said conductor means, said energizing electrical path disconnectable in response to said first thermostatic control means sensing within said housing a temperature exceeding a first reference level; and second connector means for electrically connecting said solar panel and said battery, said second connector means including second thermostatic control means for providing a recharging electrical path between said solar panel and said battery, said recharging electrical path disconnectable in response to said second thermostatic control means sensing a temperature exceeding a second reference level, said second reference level being at least as great as said first reference level.

2. An apparatus as defined in claim 1, wherein said first reference level is approximately 40° F. and said second reference level is approximately 50° F.

3. An apparatus as defined in claim 1, wherein:

the fluid-control device disposed at the well is a gas regulator which is responsive to atmospheric pressure control;

said first member of said housing includes a first outer shell, a first inner shell associated with said first outer shell so that a first void region is defined therebetween, and first insulation material disposed in said first void region; and said second member of said housing includes a second outer shell, a second inner shell associated with said second outer shell so that a second void region is defined therebetween, and second insulation material disposed in said second void region, and said second member further includes a vent opening defined through said second outer shell, said second insulation material and said second inner shell so that atmospheric pressure is communicated therethrough for controlling the gas regulator when said housing is mounted thereon.

4. An apparatus as defined in claim 3, further comprising a vent cover rotatably disposed in said vent opening, said vent cover having liquid-shedding louvers for resisting entry of liquids into said housing through said vent opening.

5. An apparatus as defined in claim 4, wherein said first reference level is approximately 40° F. and said second reference level is approximately 50° F.

6. An apparatus for heating a fluid-control device connected in a pipeline disposed at a well, said apparatus comprising:

a heating pad for applying heat to the portion of a fluid-control device which is connected directly in a pipeline disposed at a well, said pad including:

a first flexible member having a central web and four legs extending outward from said web;

means for connecting a first one of said legs to a second one of said legs about the fluid-control device;

means for connecting a third one of said legs to a fourth one of said legs about the fluid-control device; and first heating element means, disposed in said flexible member, for generating heat in response to electricity;

a heating collar for applying heat to another portion of the fluid-control device, which another portion extends outwardly from the first-mentioned portion of the fluid-control device, said heating collar including:

a second flexible member, said second flexible member having a rectangular shape which defines a ring-like configuration when said second flexible member is connected around the fluid-control device; and second heating element means, disposed in said second flexible member, for generating heat in response to electricity;

an insulated housing having an interior cavity defined therein, said housing including a first member, a second member and means for connecting said first member to said second member about said heating pad and said heating collar when said housing is installed on the fluid-control device, said second member including a vent opening defined therein so that atmospheric air is communicated with the interior of said housing;

a rechargeable battery;

a solar panel for generating electricity to recharge said battery;

first connector means for electrically connecting said battery to said first heating element means, said first connector means including first thermostatic control means, disposed in said housing, for providing between said battery and said first heating element means a disconnectable electrical path responsive to said first thermostatic control means sensing within said housing a temperature exceeding a first reference level;

second connector means for electrically connecting said solar panel and said battery, said second connector means including second thermostatic control means for providing between said solar panel and said battery a disconnectable electrical path responsive to said second thermostatic control means sensing a temperature exceeding a second reference level which is greater than said first reference level; and a vent cover rotatably disposed in said vent opening, said vent cover having liquid-shedding louvers for resisting entry of liquids into said housing through said vent opening.

7. An apparatus as defined in claim 6, wherein said first reference level is approximately 40° F. and said second reference level is approximately 50° F.

* * * * *